US010372047B2

(12) United States Patent
Shimizu et al.

(10) Patent No.: US 10,372,047 B2
(45) Date of Patent: Aug. 6, 2019

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Tomofumi Shimizu, Osaka (JP); Kiichiro Oji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/879,853

(22) Filed: Jan. 25, 2018

(65) Prior Publication Data

US 2018/0215183 A1 Aug. 2, 2018

(30) Foreign Application Priority Data

Jan. 27, 2017 (JP) ..... 2017-013412

(51) Int. Cl.

*G03G 5/06* (2006.01)
*G03G 5/05* (2006.01)
*G03G 5/09* (2006.01)

(52) U.S. Cl.

CPC ..... *G03G 5/0603* (2013.01); *G03G 5/0514* (2013.01); *G03G 5/0521* (2013.01); (Continued)

(58) Field of Classification Search

CPC .. G03G 5/0629; G03G 5/0603; G03G 5/0642; G03G 5/0521; G03G 5/0514; G03G 5/0609

See application file for complete search history.

(56) References Cited

U.S. PATENT DOCUMENTS 4,218,247 A * 8/1980 Hara ..... C08G 14/02 252/501.1
4,419,429 A * 12/1983 Nakazawa ..... G03G 5/0696 430/83

(Continued)

FOREIGN PATENT DOCUMENTS

EP 1 420 303 A2 5/2004
JP 49078553 A * 7/1974

(Continued)

OTHER PUBLICATIONS

English language machine translation of JP 2001-249470-A (Sep. 2011).*

(Continued)

*Primary Examiner* — Christopher D Rodee
(74) *Attorney, Agent, or Firm* — Studebaker & Brackett PC

(57) ABSTRACT

An electrophotographic photosensitive member includes a conductive substrate and a photosensitive layer. The photosensitive layer is a single-layer photosensitive layer. The photosensitive layer contains a charge generating material, a hole transport material, an electron transport material, a binder resin, and an additive. The additive contains a carboxylic acid anhydride. A reduction potential of the carboxylic acid anhydride is at least −1.40 V versus a reference electrode ($Ag/Ag^+$). The carboxylic acid anhydride is contained in an amount of at least 0.02 parts by mass and no greater than 10.00 parts by mass relative to 100 parts by mass of the binder resin.

6 Claims, 4 Drawing Sheets

(52) U.S. Cl.
CPC ..... *G03G 5/0609* (2013.01); *G03G 5/0629* (2013.01); *G03G 5/0637* (2013.01); *G03G 5/0642* (2013.01); *G03G 5/0661* (2013.01); *G03G 5/09* (2013.01)

(56) References Cited

U.S. PATENT DOCUMENTS

| | | | | |
|---|---|---|---|---|
| 7,029,812 | B2 * | 4/2006 | Tokarski | G03G 5/06 430/119.6 |
| 2003/0211413 | A1 * | 11/2003 | Lin | G03G 5/04 430/78 |
| 2004/0022558 | A1 * | 2/2004 | Okano | G03G 15/0208 399/175 |
| 2006/0003242 | A1 | 1/2006 | Lee et al. | |
| 2006/0183044 | A1 * | 8/2006 | Kim | C07D 471/06 430/78 |
| 2008/0008952 | A1 * | 1/2008 | Lim | G03G 5/047 430/59.5 |

FOREIGN PATENT DOCUMENTS

| | | | |
|---|---|---|---|
| JP | 62042162 | A * | 2/1987 |
| JP | 03163559 | A * | 7/1991 |
| JP | 2001249470 | A * | 9/2001 |
| JP | 2006-018302 | A | 1/2006 |
| WO | WO-2018061368 | A1 * | 4/2018 |

OTHER PUBLICATIONS

English language machine translation of JP 49-078553-A (Jul. 1974).*

English language machine translation of WO 2018061368-A1 (Apr. 2018).*

Diamond, A.S. (ed). Handbook of Imaging Materials. New York: Marcel-Dekker, Inc. (2002) pp. 401-403.*

Diamond, A.S. (ed). Handbook of Imaging Materials. New York: Marcel-Dekker, Inc. (2002) pp. 145-164.*

English language machine translation of JP 2923312-B (Jul. 1995).*

English language machine translation of JP 62-042162 (Feb. 1987).*

English language machine translation of WO 2018/061368 (Apr. 2018).*

The extended European search report issued by the European Patent Office dated Apr. 5, 2018, which corresponds to EP18153218.5-1107 and is related to U.S. Appl. No. 15/879,853.

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2017-13412, filed on Jan. 27, 2017. The contents of this application are incorporated herein by reference in their entirety.

BACKGROUND

The present disclosure relates to electrophotographic photosensitive members, process cartridges, and image forming apparatuses.

An electrophotographic image forming apparatus (for example, a printer or a multifunction peripheral) includes an electrophotographic photosensitive member as an image bearing member. In general, an electrophotographic photosensitive member includes a photosensitive layer. The photosensitive layer for example contains a charge generating material, a charge transport material (specific examples include a hole transport material and an electron transport material), and a resin (binder resin) for binding the aforementioned materials. The electrophotographic photosensitive member for example includes the charge generating material and the charge transport material in one layer (photosensitive layer) and implements both a charge generating function and a charge transport function with the one layer. Such an electrophotographic photosensitive member is referred to as a single-layer electrophotographic photosensitive member.

Succinic anhydride-based compounds are known as electron transport materials of electrophotographic photosensitive members.

SUMMARY

An electrophotographic photosensitive member according to an aspect of the present disclosure includes a conductive substrate and a photosensitive layer. The photosensitive layer is a single-layer photosensitive layer. The photosensitive layer contains a charge generating material, a hole transport material, an electron transport material, a binder resin, and an additive. The additive contains a carboxylic acid anhydride. A reduction potential of the carboxylic acid anhydride is at least −1.40 V versus a reference electrode ($Ag/Ag^+$). The carboxylic acid anhydride is contained in an amount of at least 0.02 parts by mass and no greater than 10.00 parts by mass relative to 100 parts by mass of the binder resin.

A process cartridge according to another aspect of the present disclosure includes the above-described electrophotographic photosensitive member.

An image forming apparatus according to another aspect of the present disclosure includes an image bearing member, a charger, a light exposure section, a development section, and a transfer section. The image bearing member is the above-described electrophotographic photosensitive member. The charger charges a surface of the image bearing member. The charger has a positive charging polarity. The light exposure section exposes the charged surface of the image bearing member to light to form an electrostatic latent image. The development section develops the electrostatic latent image into a toner image. The transfer section transfers the toner image from the surface of the image bearing member to a recording medium.

DETAILED DESCRIPTION

Figure 1A:
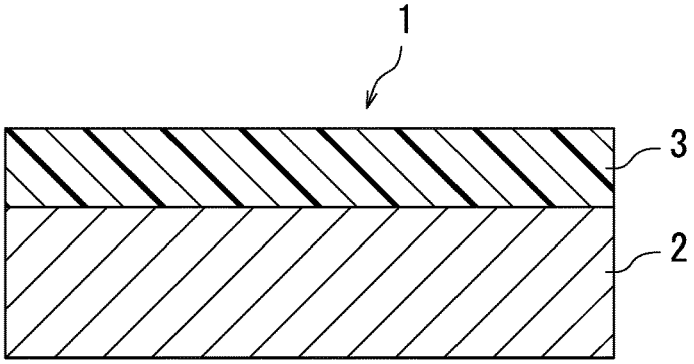
FIG. 1A is a schematic cross-sectional view illustrating a structure of an electrophotographic photosensitive member according to a first embodiment of the present disclosure.

The following describes embodiments of the present disclosure in detail. However, the present disclosure is not in any way limited by the following embodiments. Appropriate changes may be made when practicing the present disclosure so long as such changes do not deviate from the intended scope of the present disclosure. Note that although description is omitted as appropriate in some places in order to avoid repetition, such omission does not limit the essence of the present disclosure.

Note that the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, a halogen atom, a hetero atom, an alkyl group having a carbon number of at least 1 and no greater than 6, an alkyl group having a carbon number of at least 1 and no greater than 3, an alkynyl group having a carbon number of at least 2 and no greater than 4, an aryl group having a carbon number of at least 6 and no greater than 14, an aromatic hydrocarbon ring having a carbon number of at least 6 and no greater than 14, and an aromatic heterocycle having a carbon number of at least 3 and no greater than 14 each refer to the following unless otherwise stated.

A halogen atom as used herein for example refers to a fluorine atom, a chlorine atom, a bromine atom, or an iodine atom.

A hetero atom as used herein for example refers to an oxygen atom, a nitrogen atom, and a sulfur atom.

An alkyl group having a carbon number of at least 1 and no greater than 6 as used herein refers to an unsubstituted straight chain or branched chain alkyl group. Examples of the alkyl group having a carbon number of at least 1 and no greater than 6 include a methyl group, an ethyl group, an n-propyl group, an isopropyl group, an n-butyl group, an s-butyl group, a t-butyl group, a pentyl group, an isopentyl group, a neopentyl group, and an n-hexyl group.

An alkyl group having a carbon number of at least 1 and no greater than 3 as used herein refers to an unsubstituted straight chain or branched chain alkyl group. Examples of the alkyl group having a carbon number of at least 1 and no greater than 3 include a methyl group, an ethyl group, an n-propyl group, and an isopropyl group.

An alkynyl group having a carbon number of at least 2 and no greater than 4 as used herein refers to an unsubstituted alkynyl group. Examples of the alkynyl group having a carbon number of at least 2 and no greater than 4 include an ethynyl group, a propynyl group (specific examples include a prop-1-yn-1-yl group and a prop-2-yn-1-yl group) and a butynyl group (specific examples include a but-1-yn-1-yl group, a but-1-yn-2-yl group, and a but-2-yn-1-yl group).

An aryl group having a carbon number of at least 6 and no greater than 14 as used herein refers to an unsubstituted aryl group. An aryl group having a carbon number of at least 6 and no greater than 14 as used herein is for example an unsubstituted monocyclic aromatic hydrocarbon group having a carbon number of at least 6 and no greater than 14, an unsubstituted fused bicyclic aromatic hydrocarbon group having a carbon number of at least 6 and no greater than 14, or an unsubstituted fused tricyclic aromatic hydrocarbon group having a carbon number of at least 6 and no greater than 14. Examples of the aryl group having a carbon number of at least 6 and no greater than 14 include a phenyl group, a naphthyl group, an anthryl group, and a phenanthryl group.

An aromatic hydrocarbon ring having a carbon number of at least 6 and no greater than 14 as used herein is for example a benzene ring, a naphthalene ring, an anthracene ring, and a phenanthrene ring.

An aromatic heterocycle having a carbon number of at least 3 and no greater than 14 as used herein includes at least one hetero atom. Examples of the aromatic heterocycle having a carbon number of at least 3 and no greater than 14 include monocyclic and polycyclic aromatic heterocycles. Examples of monocyclic aromatic heterocycles include a pyrrole ring, a furan ring, a thiophene ring, an imidazole ring, a pyrazole ring, an oxazole ring, an isoxazole ring, a thiazole ring, an isothiazole ring, a pyridine ring, a pyrimidine ring, and a pyrazine ring. Examples of polycyclic aromatic heterocycles include a quinoline ring, an isoquinoline ring, an indole ring, a benzofuran ring, and an acridine ring.

First Embodiment: Electrophotographic Photosensitive Member

The first embodiment relates to an electrophotographic photosensitive member (also referred to below as a photosensitive member). The photosensitive member according to the first embodiment can achieve both excellent sensitivity characteristics and excellent toner image transferring ability. The reason for the above is thought to be as follows.

A reduction in transferring ability will be described first for convenience. An electrographic image forming apparatus for example includes an image bearing member (photosensitive member), a charger, a light exposure section, a development section, and a transfer section. The transfer section transfers a toner image from the photosensitive member to a recording medium. In a situation in which the surface potential of an exposed region of the photosensitive member decreases to less than −30 V in a transfer process performed by the transfer section, the efficiency of transferring the toner image from the photosensitive member to the recording medium may decrease. Such a reduction in the toner image transferring ability is likely to occur particularly in a high temperature and humidity environment.

The photosensitive member according to the first embodiment includes a photosensitive layer containing a carboxylic acid anhydride as an additive. A reduction potential of the carboxylic acid anhydride is at least −1.40 V versus a reference electrode ($Ag/Ag^+$). The carboxylic acid anhydride is contained in an amount of at least 0.02 parts by mass and no greater than 10.00 parts by mass relative to 100 parts by mass of a binder resin in the photosensitive layer. As a result of the reduction potential of the carboxylic acid anhydride being at least −1.40 V and the amount of the carboxylic acid anhydride being at least 0.02 parts by mass, the photosensitive member tends to have appropriate electric resistance. It is thought that as a result, the photosensitive member according to the first embodiment maintains a stable surface potential, and thus maintains a stable electrostatic latent image. Furthermore, as a result of the amount of the carboxylic acid anhydride being no greater than 10.00 parts by mass, the carboxylic acid anhydride tends to uniformly disperse in the photosensitive layer. It is therefore thought that the photosensitive member according to the first embodiment has excellent sensitivity characteristics. If the amount of the carboxylic acid anhydride is less than 0.02 parts by mass, the toner image transferring ability tends to decrease. If the amount of the carboxylic acid anhydride is greater than 10.00 parts by mass, the carboxylic acid anhydride tends to crystallize in the photosensitive layer. The crystallization of the carboxylic acid anhydride in the photosensitive layer is likely to reduce sensitivity characteristics of the photosensitive member. For the above reasons, it is thought that the photosensitive member according to the first embodiment can achieve both excellent sensitivity characteristics and excellent toner image transferring ability.

The reduction potential of the carboxylic acid anhydride is at least −1.40 V versus the reference electrode ($Ag/Ag^+$), and preferably at least −1.40 V and no greater than −0.70 V. If the reduction potential of the carboxylic acid anhydride is less than −1.40V, the toner image transferring ability tends to decrease. A method for measuring the reduction potential of the carboxylic acid anhydride is described below in Examples.

The amount of the carboxylic acid anhydride is at least 0.02 parts by mass and no greater than 10.00 parts by mass relative to 100 parts by mass of the binder resin, preferably at least 0.20 parts by mass and no greater than 7.00 parts by mass, and more preferably at least 0.50 parts by mass and no greater than 5.00 parts by mass.

As a result of the reduction potential of the carboxylic acid anhydride being at least −1.40 V and the amount of the carboxylic acid anhydride being at least 0.02 parts by mass relative to 100 parts by mass of the binder resin, the surface potential of an exposed region of the photosensitive member exposed to light by the light exposure section is easily adjustable within a preferable range. The exposed region of the photosensitive member exposed to light by the light exposure section preferably has a surface potential of at least −80 V, more preferably at least −30 V, and still more preferably at least 0 V, and particularly preferably at least 0 V and no greater than +10 V. As a result of the exposure region of the photosensitive member having a surface potential of at least −30 V, electrostatic attraction tends not to occur between a positively charged toner and the exposed region of the photosensitive member, making the toner image easily transferrable from the photosensitive member to the recording medium.

The surface potential of the exposed region of the photosensitive member can be measured using an electrometer ("MODEL 244", product of Monroe Electronics, Inc.). The surface potential of the exposed region of the photosensitive member is measured after the transfer section transfers a toner image from the photosensitive member to a recording medium in a rotation (also referred to below as a reference rotation) of the photosensitive member for image formation in an image forming apparatus according to a second embodiment described below and before the charger charges a surface of the photosensitive member in a rotation following the reference rotation. A method for measuring the surface potential of the exposed region of the photosensitive member is described in detail below in Examples.

Figure 1B:
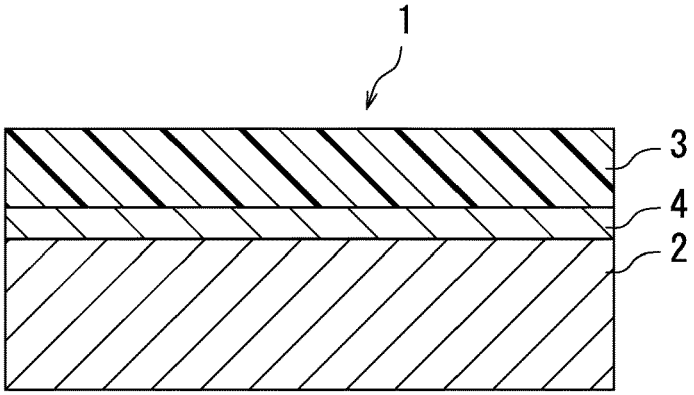
FIG. 1B is a schematic cross-sectional view illustrating a structure of the electrophotographic photosensitive member according to the first embodiment.
Figure 1C:
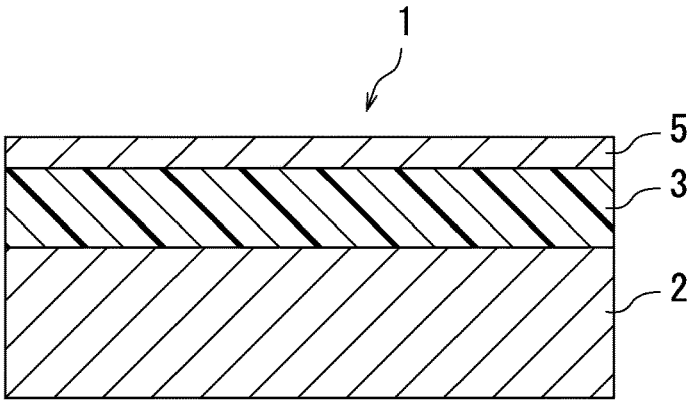
FIG. 1C is a schematic cross-sectional view illustrating a structure of the electrophotographic photosensitive member according to the first embodiment.

The following describes the photosensitive member with reference to FIGS. 1A to 1C. FIGS. 1A to 1C are schematic cross-sectional views each illustrating a structure of a photosensitive member 1. The photosensitive member 1 includes a conductive substrate 2 and a photosensitive layer 3. The photosensitive layer 3 is a single-layer photosensitive layer. The photosensitive layer 3 is provided directly or indirectly on the conductive substrate 2. For example, the photosensitive layer 3 may be provided directly on the conductive substrate 2 as illustrated in FIG. 1A. For example, an intermediate layer 4 may be provided between the conductive substrate 2 and the photosensitive layer 3 as illustrated in FIG. 1B. The photosensitive layer 3 may be exposed as an outermost layer as illustrated in FIGS. 1A and 1B. A protective layer 5 may be provided on the photosensitive layer 3 as illustrated in FIG. 1C. The following describes the conductive substrate 2, the photosensitive layer 3, and the intermediate layer 4. The following also describes a method for producing the photosensitive member 1.

[Conductive Substrate]

No specific limitations are placed on the conductive substrate 2 other than being a conductive substrate that can be used as a conductive substrate of the photosensitive member 1. A conductive substrate of which at least a surface portion is made from a material having electrical conductivity (also referred to below as a conductive material) can be used as the conductive substrate 2. Examples of conductive substrates that can be used include a conductive substrate formed from a conductive material and a conductive substrate having a coat of a conductive material. Examples of conductive materials that can be used include aluminum, iron, copper, tin, platinum, silver, vanadium, molybdenum, chromium, cadmium, titanium, nickel, palladium, and indium. Any one of the conductive materials listed above may be used independently, or any two or more of the conductive materials listed above may be used in combination. Examples of combinations of two or more of the conductive materials include an alloy (specific examples include an aluminum alloy, stainless steel, and brass). Of the conductive materials listed above, aluminum or an aluminum alloy is preferable in terms of favorable charge mobility from the photosensitive layer 3 to the conductive substrate 2.

The shape of the conductive substrate 2 can be selected as appropriate in accordance with the structure of an image forming apparatus in which the conductive substrate 2 is to be used. The conductive substrate 2 is for example a sheet-shaped conductive substrate or a drum-shaped conductive substrate. The thickness of the conductive substrate 2 can be selected as appropriate in accordance with the shape of the conductive substrate 2.

[Photosensitive Layer]

The photosensitive layer 3 contains a charge generating material, a hole transport material, an electron transport material, a binder resin, and an additive. The additive contains a carboxylic acid anhydride. The photosensitive layer may contain additives other than the carboxylic acid anhydride as necessary. The following describes the carboxylic acid anhydride, the charge generating material, the electron transport material, the hole transport material, the binder resin, and the additives (additives other than the carboxylic acid anhydride).

(Carboxylic Acid Anhydride)

The carboxylic acid anhydride is for example a carboxylic acid anhydride represented by general formula (1), (2), (3), (4), or (5) (also referred to below as carboxylic acid anhydrides (1) to (5)).

(1)

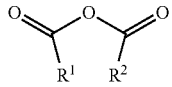

(2)

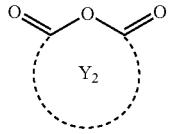

(3)

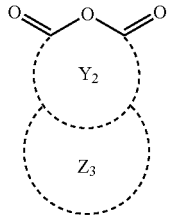

(4)

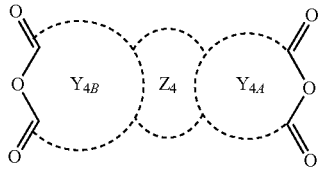

(5)

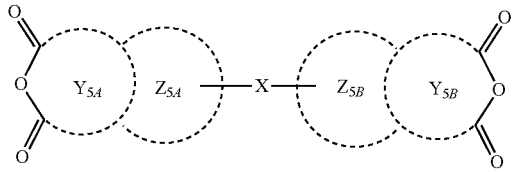

In general formula (1), $R^1$ and $R^2$ each represent, independently of one another, an alkyl group optionally having at least one halogen atom and having a carbon number of at least 1 and no greater than 6. $R^1$ and $R^2$ may be the same as or different from one another.

In general formulae (2), (3), (4), and (5), a ring $Y_2$, a ring $Y_3$, a ring $Y_{4A}$, a ring $Y_{4B}$, a ring $Y_{5A}$, and a ring $Y_{5B}$ each represent, independently of one another, a non-aromatic heterocycle having at least 5 and no greater than 7 ring members. The non-aromatic heterocycle is monocyclic. The non-aromatic heterocycle includes, as ring members, two carbon atoms and one oxygen atom of fused carboxyl groups. The non-aromatic heterocycle may further include at least one hetero atom as a ring member atom other than the oxygen atom. The non-aromatic heterocycle that may be represented by the ring $Y_2$ has at least one first sub stituent.

The non-aromatic heterocycles that may be represented by the ring $Y_3$, the ring $Y_{4A}$, the ring $Y_{4B}$, the ring $Y_{5A}$, and the ring $Y_{5B}$ each optionally have, independently of one another, at least one second substituent. The first substituent and the second substituent are each, independently of one another, a halogen atom or an aryl group having a carbon number of at least 6 and no greater than 14. The ring $Y_{4A}$ and the ring $Y_{4B}$ may be the same as or different from one another. The ring $Y_{5A}$ and the ring $Y_{5B}$ may be the same as or different from one another.

A ring $Z_3$, a ring $Z_4$, a ring $Z_{5A}$, and a ring $Z_{5B}$ are monocyclic or polycyclic. The ring $Z_3$ is fused with the ring $Y_3$, the ring $Z_4$ is fused with the rings $Y_{4A}$ and $Y_{4B}$, the ring $Z_{5A}$ is fused with the ring $Y_{5A}$, and the ring $Z_{5B}$ is fused with the ring $Y_{5B}$. The ring $Z_3$, the ring $Z_4$, the ring $Z_{5A}$, and the ring $Z_{5B}$ are each at least one aromatic hydrocarbon ring having a carbon number of at least 6 and no greater than 14 or at least one aromatic heterocycle having a carbon number of at least 3 and no greater than 14. The ring $Z_3$, the ring $Z_4$, the ring $Z_{5A}$, and the ring $Z_{5B}$ each optionally have at least one fourth substituent. However, when the ring $Z_3$ is an aromatic heterocycle, the ring $Z_3$ has the fourth substituent. The fourth substituent represents an alkynyl group that has a carbon number of at least 2 and no greater than 4 and that optionally has an aryl group having a carbon number of at least 6 and no greater than 14, an alkyl group having a carbon number of at least 1 and no greater than 6, a carboxyl group, a halogen atom, or a nitro group.

X represents a carbonyl group, a sulfonyl group, a single bond, a divalent group represented by chemical formula (5-1), an oxygen atom, or a methylene group optionally having at least one third substituent. The third substituent represents an alkyl group optionally having at least one halogen atom and having a carbon number of at least 1 and no greater than 6.

(5-1)

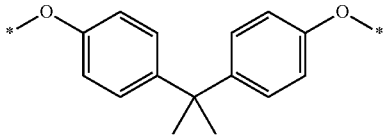

The alkyl group optionally having at least one halogen atom and having a carbon number of at least 1 and no greater than 6 that may be represented by $R^1$ or $R^2$ in general formula (1) is preferably an alkyl group having a plurality of halogen atoms and having a carbon number of at least 1 and no greater than 3, more preferably an alkyl group having a plurality of fluorine atoms or a plurality of bromine atoms and having a carbon number of at least 1 and no greater than 3, and still more preferably a chlorodifluoromethyl group or a 2,2,2-trifluoro-1,1-difluoroethyl group.

In general formula (1), $R^1$ and $R^2$ each preferably represent an alkyl group having a plurality of halogen atoms and having a carbon number of at least 1 and no greater than 3, more preferably an alkyl group having a plurality of fluorine atoms or a plurality of bromine atoms and having a carbon number of at least 1 and no greater than 3, and still more preferably a chlorodifluoromethyl group or a 2,2,2-trifluoro-1,1-difluoroethyl group. Preferably, $R^1$ and $R^2$ are the same as one another.

Examples of the carboxylic acid anhydrides (1) include carboxylic acid anhydrides represented by chemical formulae (ADD-29) and (ADD-30) (also respectively referred to below as carboxylic acid anhydrides (ADD-29) and (ADD-30)).

(ADD-29)

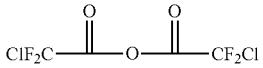

(ADD-30)

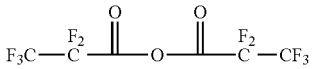

In general formulae (2), (3), (4), and (5), the non-aromatic heterocycles that may be represented by the ring $Y_2$, the ring $Y_3$, the ring $Y_{4A}$, the ring $Y_{4B}$, the ring $Y_{5A}$, and the ring $Y_{5B}$ each include two carbon atoms and one oxygen atom as ring member atoms. That is, the non-aromatic heterocycles are each a ring obtained through replacement of three carbon atoms as ring member atoms of a cycloalkyl ring having at least 5 and no greater than 7 ring members with two carbon atoms and one oxygen atom. Examples of monocyclic cycloalkyl rings each having at least 5 and no greater than 7 ring members include a cyclopentane ring, a cyclohexane ring, and a cycloheptane ring.

The two carbon atoms and the one oxygen atom of each non-aromatic heterocycle are two carbon atoms and one oxygen atom of fused carboxyl groups that are atoms on a site of fusion between the carboxyl groups represented by chemical formula (5-3). More specifically, the two carbon atoms and the one oxygen atom of each non-aromatic heterocycle are carbon atoms and an oxygen atom each indicated by a dashed circle in chemical formula (5-3). Each non-aromatic heterocycle may further include at least one hetero atom (specific examples include a nitrogen atom) as a ring member other than the oxygen atom in chemical formula (5-3).

(5-3)

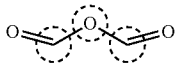

The first substituent of the ring $Y_3$ is preferably a halogen atom (specific examples include a fluorine atom) or an aryl group having a carbon number of at least 6 and no greater than 14, more preferably an aryl group having a carbon number of at least 6 and no greater than 14, and still more preferably a phenyl group.

The ring $Z_3$ is fused with the ring $Y_3$. The ring $Z_3$ is at least one aromatic hydrocarbon ring having a carbon number of at least 6 and no greater than 14 or at least one aromatic heterocycle having a carbon number of at least 3 and no greater than 14. Preferably, the ring $Z_3$ is one or two aromatic hydrocarbon rings each having a carbon number of at least 6 and no greater than 14, or one aromatic heterocycle having a carbon number of at least 3 and no greater than 14. The site of fusion between the ring $Y_3$ and the ring $Z_3$ may be a double bond.

The ring $Z_4$ is fused with the rings $Y_{4A}$ and $Y_{4B}$. The ring $Z_4$ is at least one aromatic hydrocarbon ring having a carbon number of at least 6 and no greater than 14 or at least one aromatic heterocycle having a carbon number of at least 3 and no greater than 14. Preferably, the ring $Z_4$ is one aromatic hydrocarbon ring having a carbon number of at least 6 and no greater than 14. The sites of fusion between the ring $Z_4$ and the rings $Y_{4A}$ and $Y_{4B}$ may be double bonds.

The ring $Z_{5A}$ is fused with the ring $Y_{5A}$, and the ring $Z_{5B}$ is fused with the ring $Y_{5B}$. The ring $Z_{5A}$ and the ring $Z_{5B}$ are each at least one aromatic hydrocarbon ring having a carbon number of at least 6 and no greater than 14 or at least one aromatic heterocycle having a carbon number of at least 3 and no greater than 14. Preferably, the ring $Z_{5A}$ and the ring $Z_{5B}$ are each one aromatic hydrocarbon ring having a carbon number of at least 6 and no greater than 14. The site of fusion between the ring $Y_{5A}$ and the ring $Z_{5A}$ may be a double bond. The site of fusion between the ring $Y_{5B}$ and the ring $Z_{5B}$ may be a double bond.

Preferably, X represents a carbonyl group, a sulfonyl group, a single bond, a divalent group represented by chemical formula (5-1), an oxygen atom, or a methylene group having two third substituents. The third substituents each preferably represent an alkyl group having two halogen atoms and having a carbon number of at least 1 and no greater than 6, more preferably an alkyl group having a plurality of halogen atoms and having a carbon number of at least 1 and no greater than 3, and still more preferably a methyl group having a plurality of fluorine atoms. Asterisks in the divalent substituent represented by chemical formula (5-1) indicate bonding sites.

In general formula (2), the ring $Y_2$ preferably represents a non-aromatic heterocycle having 5 ring members, and more preferably a non-aromatic heterocycle having 5 ring members including no hetero atom other than the oxygen atom in chemical formula (5-3). The non-aromatic heterocycle is monocyclic. The non-aromatic heterocycle that may be represented by the ring $Y_2$ preferably has a plurality of first substituents. The first substituents are preferably each a halogen atom or an aryl group having a carbon number of at least 6 and no greater than 14, and more preferably a fluorine atom or a phenyl group.

The carboxylic acid anhydride (2) is for example represented by general formula (2-1).

(2-1)

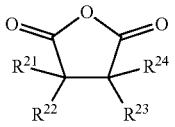

In general formula (2-1), $R^{21}$, $R^{22}$, $R^{23}$, and $R^{24}$ each represent, independently of one another, a hydrogen atom, a halogen atom, or an aryl group having a carbon number of at least 6 and no greater than 14. $R^{21}$, $R^{22}$, $R^{23}$, and $R^{24}$ do not all simultaneously represent hydrogen atoms.

Preferably, the halogen atom that may be represented by $R^{21}$, $R^{22}$, $R^{23}$, and $R^{24}$ in general formula (2-1) is a fluorine atom. Preferably, the aryl group having a carbon number of at least 6 and no greater than 14 that may be represented by $R^{21}$, $R^{22}$, $R^{23}$, and, $R^{24}$ is a phenyl group. Neither $R^{21}$ nor $R^{22}$ is bonded to $R^{23}$ or $R^{24}$ to form a ring.

Examples of the carboxylic acid anhydrides (2) include carboxylic acid anhydrides represented by chemical formulae (ADD-23) and (ADD-31) (also respectively referred to below as carboxylic acid anhydrides (ADD-23) and (ADD-31)).

(ADD-1)

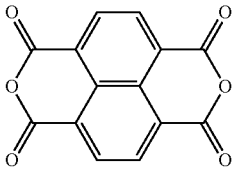

-continued (ADD-2)

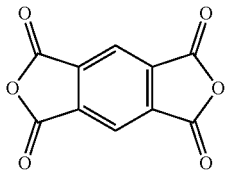

(ADD-3)

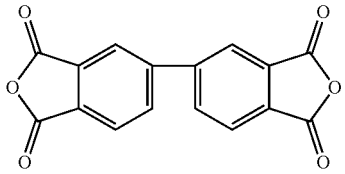

(ADD-4)

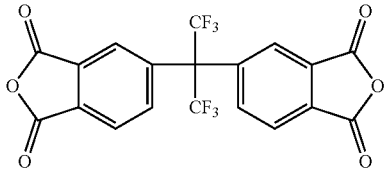

(ADD-5)

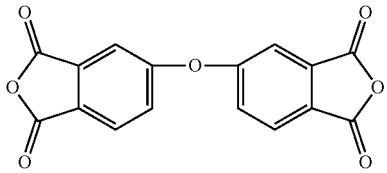

(ADD-6)

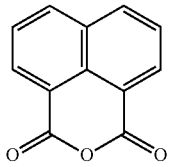

(ADD-7)

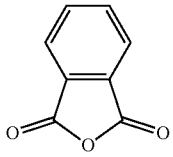

(ADD-8)

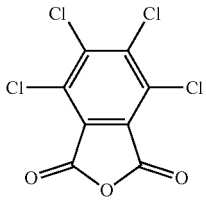

(ADD-9)

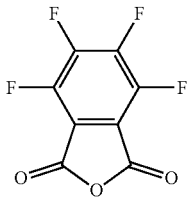

-continued
(ADD-10)
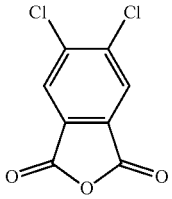
(ADD-11)
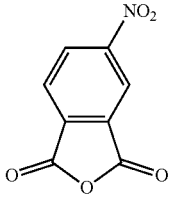
(ADD-12)
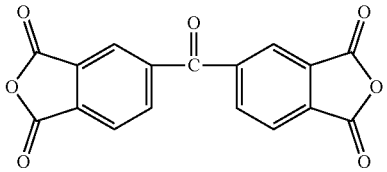
(ADD-13)
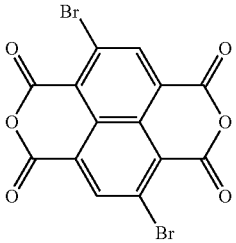
(ADD-14)
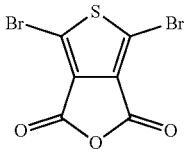
(ADD-15)
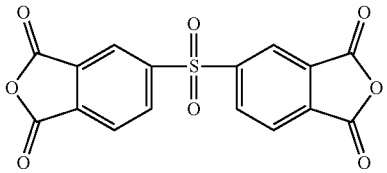
(ADD-16)
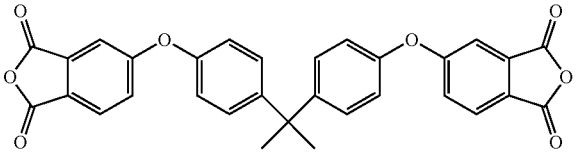
(ADD-17)
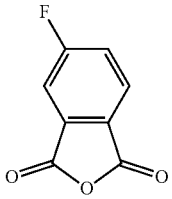
-continued
(ADD-18)
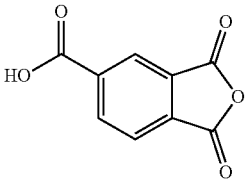
(ADD-19)
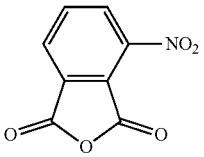
(ADD-20)
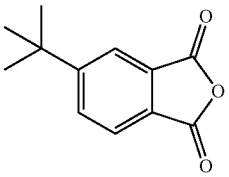
(ADD-21)
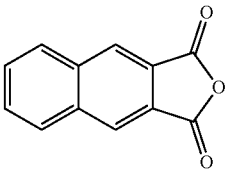
(ADD-22)
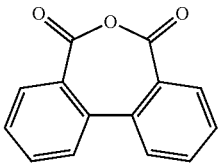
(ADD-23)
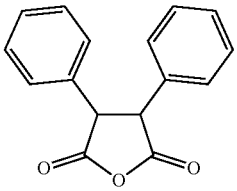
(ADD-24)
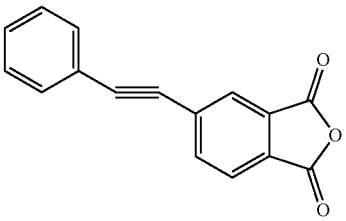
(ADD-25)
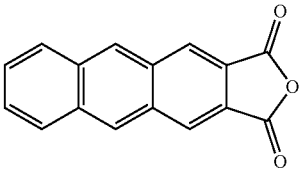

-continued (ADD-26)

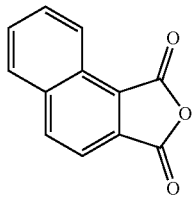

(ADD-27)

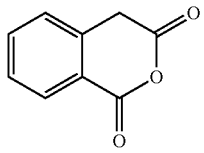

(ADD-28)

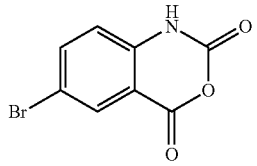

(ADD-31)

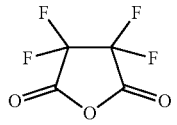

Preferably, the ring $Z_3$ in general formula (3) represents at least one benzene ring, naphthalene ring, anthracene ring, or thiophene ring. Preferably, the halogen atom as the at least one fourth substituent that the ring $Z_3$ optionally has is a fluorine atom, a chlorine atom, or a bromine atom. Preferably, the "alkyl group having a carbon number of at least 1 and no greater than 6" as the at least one fourth substituent that the ring $Z_3$ optionally has is a t-butyl group. Preferably, the "alkynyl group that has a carbon number of at least 2 and no greater than 4 and that optionally has an aryl group having a carbon number of at least 6 and no greater than 14" as the at least one fourth substituent that the ring $Z_3$ optionally has is an ethynyl group having a phenyl group.

When the ring $Z_3$ is an aromatic hydrocarbon ring having a carbon number of at least 6 and no greater than 14, the ring $Z_3$ optionally has the fourth substituent. Preferably, the fourth substituent represents a t-butyl group, a carboxyl group, a fluorine atom, a chlorine atom, a bromine atom, a nitro group, or an ethynyl group having a phenyl group.

When the ring $Z_3$ is an aromatic heterocycle having a carbon number of at least 3 and no greater than 14, the ring $Z_3$ has the fourth substituent. The fourth substituent preferably represents a halogen atom, and more preferably a bromine atom.

In general formula (3), the non-aromatic heterocycle that may be represented by the ring $Y_3$ may further include a nitrogen atom as a ring member atom other than the oxygen atom in chemical formula (5-3). Preferably, the ring $Z_3$ represents at least one benzene ring, naphthalene ring, anthracene ring, or thiophene ring, and the fourth substituent represents an alkynyl group that has a carbon number of at least 2 and no greater than 4 and that has an aryl group having a carbon number of at least 6 and no greater than 14, a halogen atom, an alkyl group having a carbon number of at least 1 and no greater than 6, a carboxyl group, or a nitro group. More preferably, the fourth substituent represents a fluorine atom, a chlorine atom, a bromine atom, a t-butyl group, a carboxyl group, a nitro group, or an ethynyl group having a phenyl group.

Examples of the carboxylic acid anhydrides (3) include carboxylic acid anhydrides represented by chemical formulae (ADD-6) to (ADD-11), (ADD-14), (ADD-17) to (ADD-22), and (ADD-24) to (ADD-28) (also respectively referred to below as carboxylic acid anhydrides (ADD-6) to (ADD-11), (ADD-14), (ADD-17) to (ADD-22), and (ADD-24) to (ADD-28)).

Preferably, in general formula (4), the ring $Y_{4A}$ and the ring $Y_{4B}$ each represent a non-aromatic heterocycle having 5 or 6 ring members, the ring $Z_4$ represents a benzene ring or a naphthalene ring, and the fourth substituent represents a halogen atom (specific examples include a bromine atom).

Examples of the carboxylic acid anhydrides (4) include carboxylic acid anhydrides represented by chemical formulae (ADD-1), (ADD-2), and (ADD-13) (also respectively referred to below as carboxylic acid anhydrides (ADD-1), (ADD-2), and (ADD-13)).

Preferably, in general formula (5), the ring $Y_{5A}$ and the ring $Y_{5B}$ each represent a non-aromatic heterocycle having 5 ring members, the ring $Z_{5A}$ and the ring $Z_{5B}$ each represent one benzene ring, X represents a carbonyl group, a sulfonyl group, a single bond, a group represented by chemical formula (5-1), an oxygen atom, or a methylene group having two third substituents, and the third substituents each represent an alkyl group having a plurality of fluorine atoms and having a carbon number of at least 1 and no greater than 3 (specific examples include a trifluoromethyl group).

The carboxylic acid anhydride (5) is for example a carboxylic acid anhydride represented by general formula (5-2) (also referred to below as a carboxylic acid anhydride (5-2)).

(5-2)

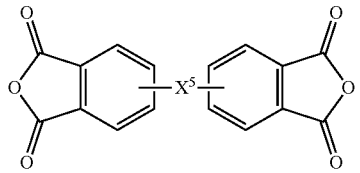

In general formula (5-2), $X^5$ represents a carbonyl group, a sulfonyl group, a single bond, a divalent group represented by chemical formula (5-1), an oxygen atom, or a methylene group having two third substituents. The third substituents each represent an alkyl group having a plurality of fluorine atoms and having a carbon number of at least 1 and no greater than 3 (specific examples include a trifluoromethyl group). Asterisks in chemical formula (5-1) indicate bonding sites.

Examples of the carboxylic acid anhydrides (5) include carboxylic acid anhydrides represented by chemical formulae (ADD-3) to (ADD-5), (ADD-12), (ADD-15), and (ADD-16) (also respectively referred to below as carboxylic acid anhydrides (ADD-3) to (ADD-5), (ADD-12), (ADD-15), and (ADD-16)).

(Charge Generating Material)

No particular limitations are placed on the charge generating material other than being a charge generating material that can be used in the photosensitive member 1. Examples of charge generating materials that can be used include phthalocyanine-based pigments, perylene pigments, bisazo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, powders of inorganic photoconductive materials (specific examples include selenium, selenium-tellurium, selenium-arsenic, cadmium sulfide, and amorphous silicon), pyrylium salts, anthanthrone-based pigments, triphenylmethane-based pigments, threne-based pigments, toluidine-based pigments, pyrazoline-based pigments, and quinacridone-based pigments.

Examples of phthalocyanine-based pigments that can be used include a metal-free phthalocyanine pigment represented by chemical formula (CGM-1) and metal phthalocyanine pigments. Examples of metal phthalocyanine pigments that can be used include a titanyl phthalocyanine pigment represented by chemical formula (CGM-2) and a phthalocyanine pigment having a metal other than titanium oxide as a coordination center (specific examples include a V-form hydroxygallium phthalocyanine pigment). The phthalocyanine-based pigments may be crystalline or non-crystalline. No particular limitations are placed on the crystal structure (for example, α-form, β-form, or y-form) of the phthalocyanine-based pigments, and phthalocyanine-based pigments having various different crystal structures may be used.

(CGM-1)

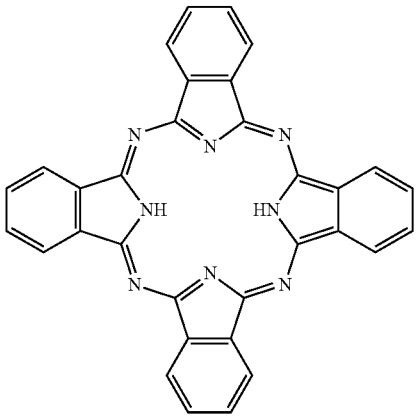

(CGM-2)

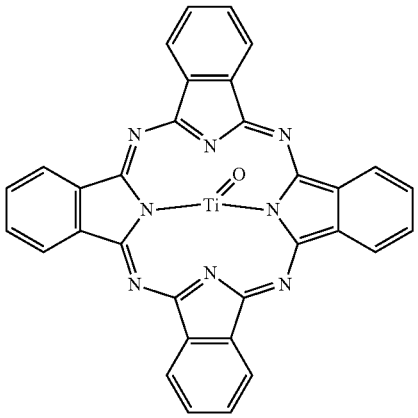

Examples of metal-free phthalocyanine pigment crystals that can be used include metal-free phthalocyanine pigments having an X-form crystal structure (also referred to below as X-form metal-free phthalocyanine pigments). Examples of titanyl phthalocyanine pigment crystals that can be used include titanyl phthalocyanine pigments having an α-form, β-form, or Y-form crystal structure. In a situation in which the photosensitive layer includes a carboxylic acid anhydride as an additive, the charge generating material is preferably a metal-free phthalocyanine pigment.

Preferably, the reduction potential of the charge generating material is at least −1.40 V and no greater than −1.30 V versus a reference electrode ($Ag/Ag^+$). The reduction potential of the charge generating material is preferably at least −1.40 V and no greater than −1.30 V because carrier (electron) exchange between the charge generating material and the carboxylic acid anhydride occurs smoothly, and sensitivity characteristics and toner image transferring ability of the photosensitive member 1 are further improved.

Any one charge generating material or a combination of two or more charge generating materials that is absorptive with respect to light in a desired wavelength region may be used. For example, in a digital optical image forming apparatus such as a laser beam printer or a facsimile machine that uses a light source such as a semiconductor laser, the photosensitive member 1 that is sensitive to a region of wavelengths of at least 700 nm is preferably used. Therefore, a phthalocyanine-based pigment is preferable, and a metal-free phthalocyanine pigment is more preferable. One charge generating material may be used independently, or two or more charge generating materials may be used in combination.

A photosensitive member included in an image forming apparatus that includes a short-wavelength laser light source preferably contains an anthanthrone-based pigment or a perylene-based pigment as a charge generating material. The short-wavelength laser light for example has a wavelength of at least 350 nm and no greater than 550 nm.

The charge generating material is preferably contained in an amount of at least 0.1 parts by mass and no greater than 50 parts by mass relative to 100 parts by mass of the binder resin, and more preferably at least 0.5 parts by mass and no greater than 30 parts by mass.

(Hole Transport Material)

Examples of hole transport materials that can be used include triphenylamine derivatives, diamine derivatives (specific examples include N,N,N',N'-tetraphenylbenzidine derivatives, N,N,N',N'-tetraphenylphenylenediamine derivatives, N,N,N',N'-tetraphenylnaphtylenediamine derivatives, di(aminophenylethenyl)benzene derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific example include 9-(4-diethylaminostyryl)anthracene), carbazole-based compounds (specific examples include polyvinyl carbazole), organic polysilane compounds, pyrazoline-based compound (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. Any one of the hole transport materials listed above may be used independently, or any two or more of the hole transport materials listed above may be used in combination. Of the hole transport materials listed above, a compound represented by general formula (HTM) is more preferable.

(HTM)

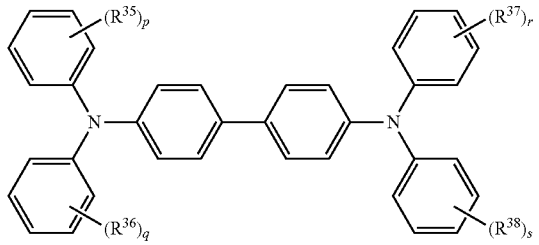

In general formula (HTM), $R^{35}$, $R^{36}$, $R^{37}$, and $R^{38}$ each represent, independently of one another, an alkyl group having a carbon number of at least 1 and no greater than 6. p, q, r, and s each represent, independently of one another, an integer of at least 0 and no greater than 5. In general formula (HTM), the alkyl group having a carbon number of at least 1 and no greater than 6 that may be represented by $R^{35}$, $R^{36}$, $R^{37}$, and $R^{38}$ is preferably an alkyl group having a carbon number of at least 1 and no greater than 3, and more preferably a methyl group. Preferably, p, q, r, and s each represent, independently of one another, 0 or 1. More preferably, p and r each represent 1, and q and s each represent 0; or p and r each represent 0, and q and s each represent 1.

The hole transport material represented by general formula (HTM) is for example a compound represented by chemical formula (HTM-1) (also referred to below as a hole transport material (HTM-1)).

(HTM-1)

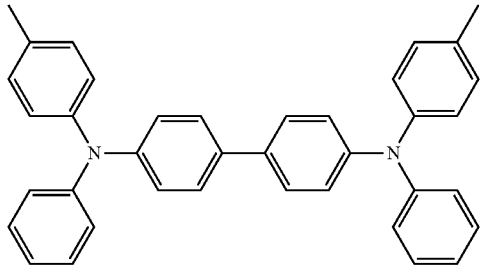

The total amount of hole transport material is preferably at least 10 parts by mass and no greater than 200 parts by mass relative to 100 parts by mass of the binder resin, and more preferably at least 10 parts by mass and no greater than 100 parts by mass.

(Electron Transport Material)

Examples of electron transport materials that can be used include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds that can be used include diphenoquinone-based compounds, azoquinone-based compounds, anthraquinone-based compounds, naphthoquinone-based compounds, nitroanthraquinone-based compounds, and dinitroanthraquinone-based compounds. Any one of the electron transport materials listed above may be used independently, or any two or more of the electron transport materials listed above may be used in combination. Of the electron transport materials listed above, a compound represented by general formula (ETM) is preferable.

(ETM)

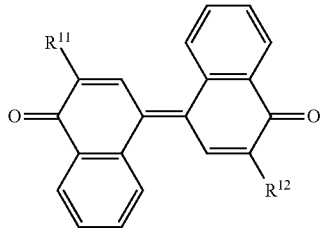

In general formula (ETM), $R^{11}$ and $R^{12}$ each represent, independently of one another, an alkyl group having a carbon number of at least 1 and no greater than 6. Preferably, the alkyl group having a carbon number of at least 1 and no greater than 6 that may be represented by $R^{11}$ and $R^{12}$ in general formula (ETM) is a 2-methyl-2-butyl group. The electron transport material represented by general formula (ETM) is for example a compound represented by chemical formula (ETM-1) (also referred to below as an electron transport material (ETM-1)).

(ETM-1)

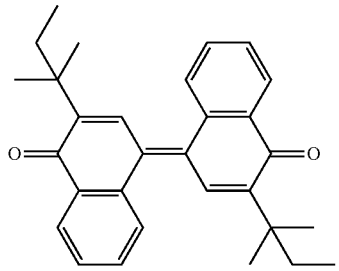

The amount of the electron transport material is preferably at least 5 parts by mass and no greater than 100 parts by mass relative to 100 parts by mass of the binder resin, and more preferably at least 10 parts by mass and no greater than 80 parts by mass.

(Binder Resin)

Examples of binder resins that can be used include thermoplastic resins, thermosetting resins, and photocurable resins. Examples of thermoplastic resins that can be used include polyester resins, polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polyarylate resins, polysulfone resins, diallyl phthalate resins, ketone resins, polyvinyl butyral resins, and polyether resins. Examples of thermosetting resins that can be used include silicone resins, epoxy resins, phenolic resins, urea resins, melamine resins, and other crosslinkable thermosetting resins. Examples of photocurable resins that can be used include epoxy acrylate resins and urethane-acrylate copolymers. Any one of the binder resins listed above may be used independently, or any two or more of the binder resins listed above may be used in combination.

Of the binder resins listed above, a polycarbonate resin is preferable. The binder resin is preferably a polycarbonate resin in terms of easily providing a photosensitive layer that has an excellent balance of workability, mechanical strength, optical characteristics, and abrasion resistance. The polycarbonate resin is preferably a bisphenol Z polycarbonate resin, a bisphenol CZ polycarbonate resin, or a bisphenol C polycarbonate resin, and more preferably a resin represented by chemical formula (Z), (C), or (CZ), in terms of easily improving toner image transferring ability of the photosensitive member. In chemical formulae (Z), (C), and (CZ), the number attached to each of the repeating units indicates the mole fraction of the repeating unit relative to the total number of moles of repeating units included in a resin having the repeating unit.

the photosensitive layer 3. The intermediate layer 4 for example includes inorganic particles and a resin (intermediate layer resin). It is thought that provision of the intermediate layer 4 maintains insulation to a sufficient degree so as to inhibit occurrence of leakage current. It is also thought that provision of the intermediate layer 4 facilitates flow of current generated when the photosensitive member is exposed to light and inhibits increasing resistance.

Examples of inorganic particles that can be used include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). Any one of the types of inorganic particles listed above may be used independently, or any two or more of the types of inorganic particles listed above may be used in combination.

(Z)

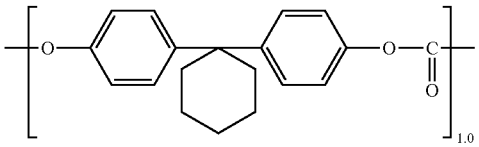

(C)

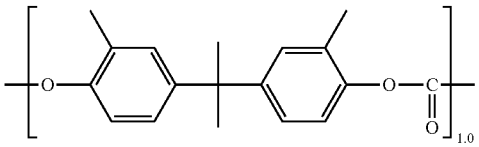

(CZ)

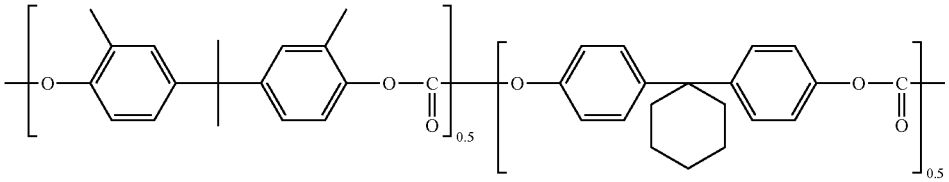

The binder resin preferably has a viscosity average molecular weight of at least 40,000, and more preferably at least 40,000 and no greater than 52,500. As a result of the viscosity average molecular weight of the binder resin being at least 40,000, abrasion resistance of the photosensitive member 1 is easily improved. As a result of the viscosity average molecular weight of the binder resin being no greater than 52,500, the binder resin has a high tendency to dissolve in a solvent and viscosity of an application liquid for photosensitive layer formation has a low tendency to be too high during formation of the photosensitive layer 3. Thus, the photosensitive layer 3 is readily formed.

(Additives Other than Carboxylic Acid Anhydrides (1) to (5))

Examples of additives that can be used other than the carboxylic acid anhydrides (1) to (5) include antidegradants (specific examples include antioxidants, radical scavengers, quenchers, and ultraviolet absorbing agents), softeners, surface modifiers, extenders, thickeners, dispersion stabilizers, waxes, acceptors, donors, surfactants, plasticizers, sensitizers, and leveling agents.

[Intermediate Layer]

The intermediate layer (in particular, undercoat layer) 4 is for example located between the conductive substrate 2 and No particular limitations are placed on the intermediate layer resin other than being a resin that can be used to form the intermediate layer 4.

The intermediate layer 4 may contain various types of additives so long as electrophotographic characteristics of the photosensitive member 1 are not adversely affected. The additives are the same as defined for the additives for the photosensitive layer 3.

[Production Method of Photosensitive Member]

The following describes a production method of the photosensitive member 1 with reference to FIG. 1A. The production method of the photosensitive member 1 includes a photosensitive layer formation process. The following describes the photosensitive layer formation process.

(Photosensitive Layer Formation Process)

In the photosensitive layer formation process, an application liquid for photosensitive layer formation (also referred to below as an application liquid) is applied onto the conductive substrate 2, thereby forming a film. At least a portion of a solvent included in the film is removed to form the photosensitive layer 3. The photosensitive layer formation process for example includes an application liquid preparation process, an application process, and a drying process. The following describes the application liquid preparation process, the application process, and the drying process.

(Application Liquid Preparation Process)

In the application liquid preparation process, the application liquid is prepared. The application liquid contains at least a charge generating material, a hole transport material, an electron transport material, a binder resin, a carboxylic acid anhydride as an additive, and a solvent. Other additives may be contained in the application liquid as necessary. The application liquid can for example be prepared by dissolving or dispersing the charge generating material, the hole transport material, the electron transport material, the binder resin, the carboxylic acid anhydride as an additive, and the optional components in the solvent.

No particular limitations are placed on the solvent contained in the application liquid other than that the components of the application liquid should be soluble or dispersible in the solvent, and the solvent should be removable from the application liquid. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, N,N-dimethylformamide (DMF), and dimethyl sulfoxide. Any one of the solvents listed above may be used independently, or any two or more of the solvents listed above may be used in combination. Of the solvents listed above, a non-halogenated solvent is preferable.

The application liquid is obtained by mixing and dissolving or dispersing the components in the solvent. Mixing, dissolving, or dispersing can for example be performed using a bead mill, a roll mill, a ball mill, an attritor, a paint shaker, or an ultrasonic disperser.

The application liquid may contain a surfactant or a leveling agent in order to improve dispersibility of the components or improve surface flatness of the formed layer.

(Application Process)

In the application process, the application liquid is applied onto the conductive substrate 2 to form a film. No particular limitations are placed on the method by which the application liquid is applied so long as the method for example enables uniform application of the application liquid onto the conductive substrate 2. Examples of application methods that can be used include dip coating, spray coating, spin coating, and bar coating.

Preferably, the application liquid is applied by dip coating in terms of readily adjusting the thickness of the photosensitive layer 3 to a desired value. In the application process that is performed by dip coating, the conductive substrate 2 is immersed in the application liquid. Subsequently, the immersed conductive substrate 2 is drawn out of the application liquid. Through the above, the application liquid is applied onto the surface of the conductive substrate 2.

(Drying Process)

In the drying process, at least a portion of the solvent contained in the film of the application liquid is removed. No specific limitations are placed on the method by which at least a portion of the solvent contained in the film of the application liquid is removed other than being a method that enables evaporation of the solvent in the application liquid. Examples of methods that can be used to remove the solvent include heating, pressure reduction, and a combination of heating and pressure reduction. Specific examples of methods that can be used include heat treatment (hot-air drying) using a high-temperature dryer or a reduced pressure dryer. The heat treatment is for example performed for at least 3 minutes and no greater than 120 minutes at a temperature of at least 40° C. and no greater than 150° C.

The production method of the photosensitive member 1 may further include either or both of a process of forming the intermediate layer 4 and a process of forming a protective layer as necessary. In the process of forming the intermediate layer 4 and the process of forming a protective layer, known methods are selected as appropriate.

Second Embodiment: Image Forming Apparatus

Figure 2:
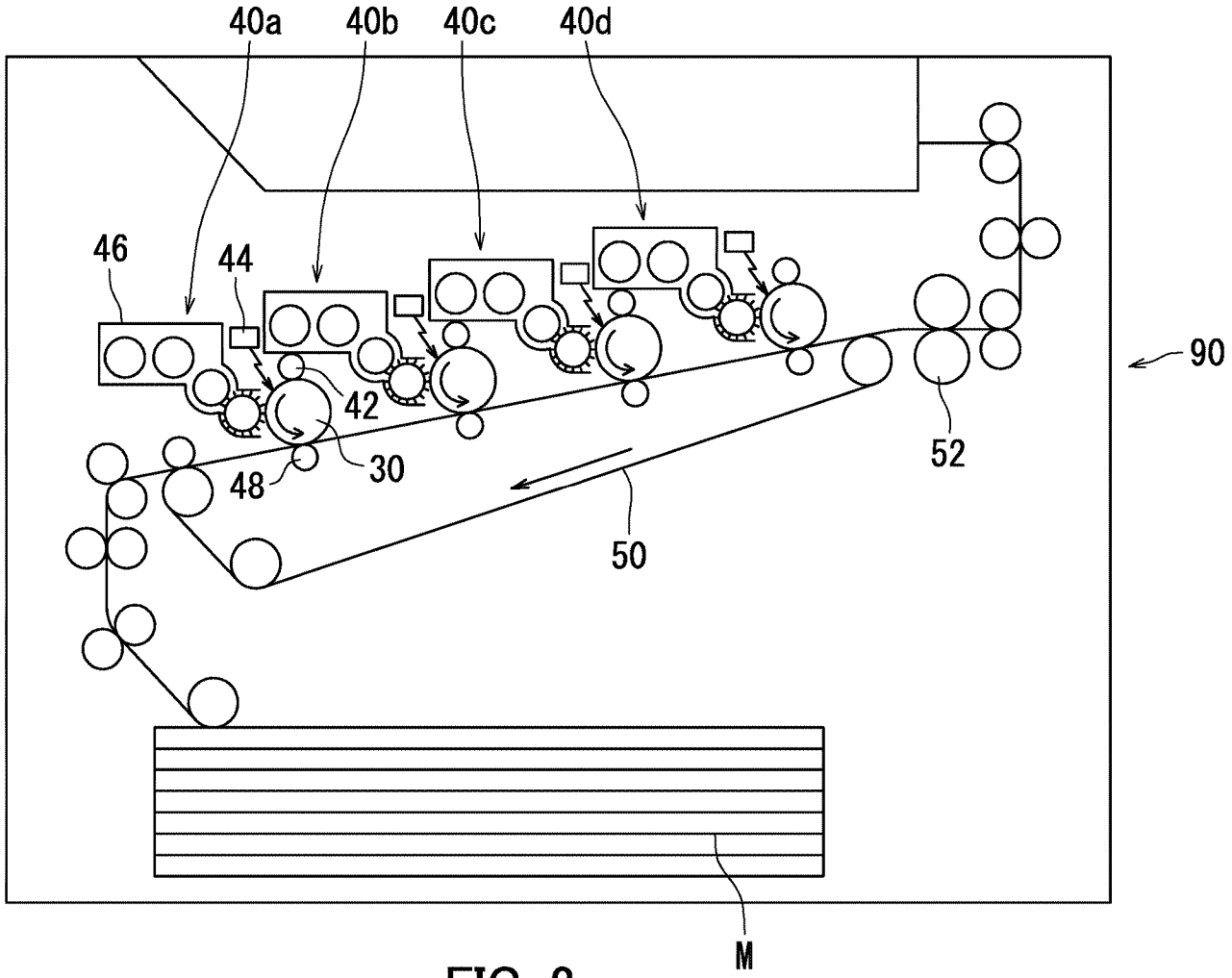
FIG. 2 is a schematic view illustrating a configuration of an image forming apparatus according to a second embodiment of the present disclosure.

The second embodiment relates to an image forming apparatus. The following describes an example of the image forming apparatus according to the second embodiment with reference to FIG. 2. FIG. 2 is a diagram illustrating an example of the image forming apparatus according to the second embodiment. An image forming apparatus 90 according to the second embodiment includes an image bearing member 30, a charger 42, a light exposure section 44, a development section 46, and a transfer section 48. The image bearing member 30 is the photosensitive member according to the first embodiment. The charger 42 charges a surface of the image bearing member 30. The charger 42 has a positive charging polarity. The "charger 42 having a positive charging polarity" means that the charger 42 charges the surface of the image bearing member 30 to a positive polarity. The light exposure section 44 forms an electrostatic latent image on the surface of the image bearing member 30 by exposing the charged surface of the image bearing member 30 to light. The development section 46 develops the electrostatic latent image into a toner image. The transfer section 48 transfers the toner image from the surface of the image bearing member 30 to a recording medium M. Through the above, an overview of the image forming apparatus 90 according to the second embodiment has been described.

The image forming apparatus 90 according to the second embodiment can form images while achieving both excellent sensitivity characteristics and excellent transferring ability. The reason for the above is thought to be as follows. The photosensitive member according to the first embodiment can achieve both excellent sensitivity characteristics and excellent toner image transferring ability as described in association with the first embodiment. The image forming apparatus 90 according to the second embodiment includes the photosensitive member according to the first embodiment, and is therefore expected to form images while achieving both excellent sensitivity characteristics and excellent transferring ability. The following describes an image defect that may occur if the image forming apparatus 90 cannot achieve both excellent sensitivity characteristics and excellent transferring ability. An image defect due to a reduction in toner image transferring ability is described as an example of the image defect.

Figure 3:
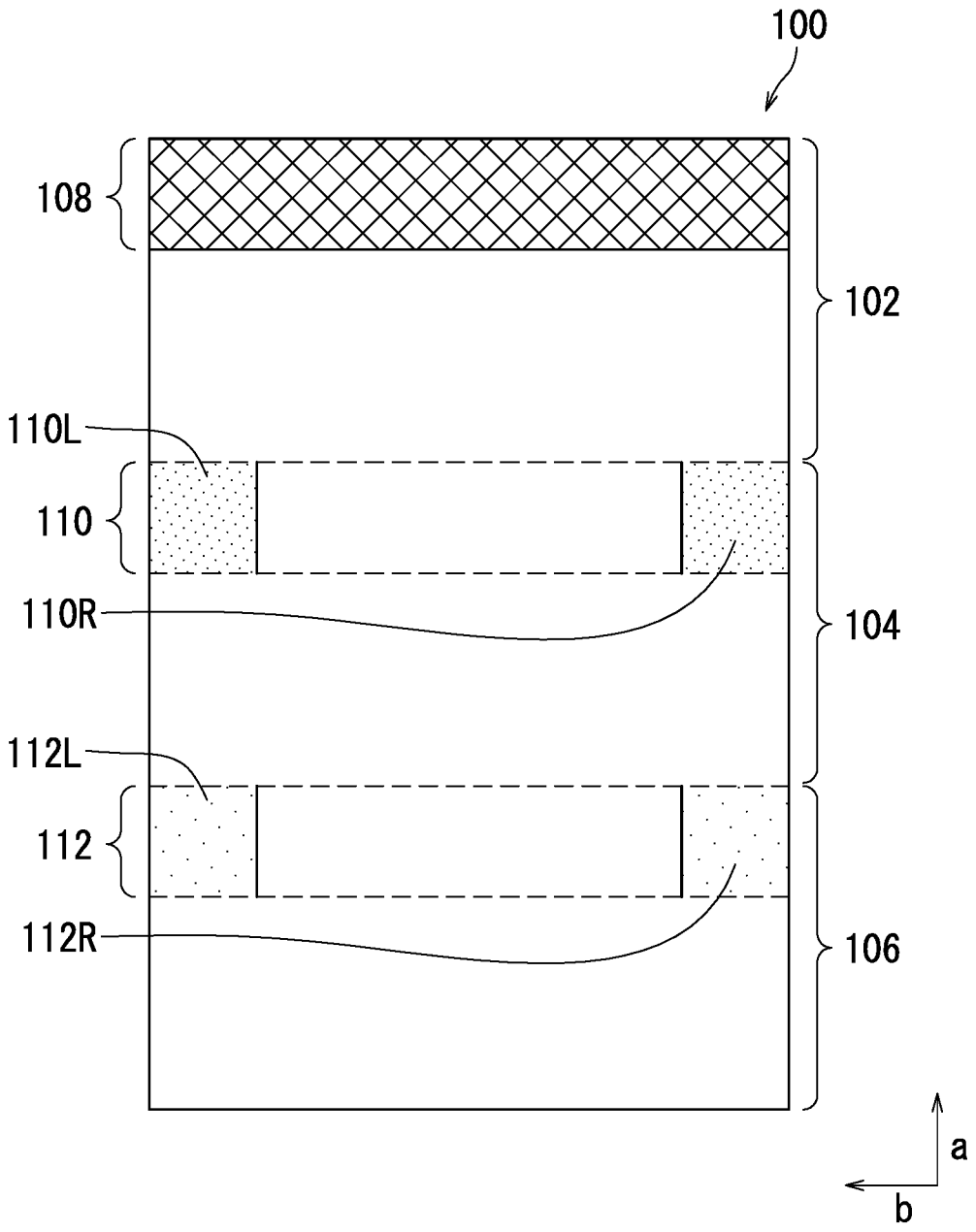
FIG. 3 is a schematic illustration of an image having an image defect.

The following further describes an image including an image defect with reference to FIG. 3. FIG. 3 is a schematic illustration of an image having an image defect due to a reduction in toner image transferring ability of a photosensitive member. An image 100 has areas 102, 104, and 106.

The areas 102, 104, and 106 are each an area corresponding to one rotation of the image bearing member 30. An image 108 in the area 102 includes a rectangular solid image (image density 100%). The areas 104 and 106 each include a white image (image density 0%) as originally designed. In a direction of conveyance a of a recording medium (conveyance direction a), the image 108 in the area 102 is first formed, the white image in the area 104 is subsequently formed, and lastly the white image in the area 106 is formed. The white image in the area 104 is an image corresponding to the next one rotation of the image bearing member 30. Specifically, the white image in the area 104 is an image corresponding to one rotation of the image bearing member 30 that is the second rotation on the assumption that the rotation of the image bearing member 30 for formation of the image 108 is the first rotation (also referred to below as a reference rotation). The white image in the area 106 is an image corresponding to one rotation after the next one rotation of the image bearing member 30. That is, the white image in the area 106 is an image corresponding to one rotation of the image bearing member 30 that is the third rotation from the reference rotation of the image bearing member 30 for formation of the image 108.

A white image in an area 110 of the area 104 is an image corresponding to the image 108. The white image in the area 110 is formed through the second rotation from the reference rotation of the image bearing member 30. A white image in an area 112 of the area 106 is an image corresponding to the image 108. The white image in the area 112 is formed through the third rotation from the reference rotation of the image bearing member 30. In such a situation, an image reflecting the image 108 is formed in either or both of the area 110 and the area 112 as an image defect. As described above, an image defect due to a reduction in toner image transferring ability of the image bearing member 30 occurs with a period based on a circumferential length of the image bearing member 30. The image reflecting the image 108 is likely to be formed at opposite ends of the recording medium. Supposedly, this is because pressing force to the opposite ends of the recording medium is relatively strong. The opposite ends of the recording medium are for example opposite ends (areas 110L and 110R) of the area 110 of the recording medium in terms of a perpendicular direction b shown in FIG. 3 or opposite ends (areas 112L and 112R) of the area 112 of the recording medium in terms of the direction b. The perpendicular direction b is a direction perpendicular to the conveyance direction a.

The following describes components of the image forming apparatus 90 according to the second embodiment in detail with reference to FIG. 2. No specific limitations are placed on the image forming apparatus 90 other than being an electrophotographic image forming apparatus. The image forming apparatus 90 may for example be a monochrome image forming apparatus or a color image forming apparatus. In a situation in which the image forming apparatus 90 is a color image forming apparatus, the image forming apparatus 90 is for example a tandem color image forming apparatus. The following describes the tandem image forming apparatus 90 as an example.

The image forming apparatus 90 adopts a direct transfer process. Typically, toner image transferring ability tends to easily decrease and an image defect due to a reduction in toner image transferring ability tends to easily occur in an image forming apparatus adopting the direct transfer process. However, the image forming apparatus 90 according to the second embodiment includes the photosensitive member according to the first embodiment as the image bearing member 30. The photosensitive member according to the first embodiment has excellent toner image transferring ability. Including the photosensitive member according to the first embodiment as the image bearing member 30, the image forming apparatus 90 is expected to be able to inhibit an image defect due to a reduction in toner image transferring ability even if the image forming apparatus 90 adopts the direct transfer process.

The image forming apparatus 90 includes image formation units 40*a*, 40*b*, 40*c*, and 40*d*, a transfer belt 50, and a fixing section 52. Hereinafter, each of the image formation units 40*a*, 40*b*, 40*c*, and 40*d* is referred to as an image formation unit 40 where it is not necessary to distinguish among the image formation units 40*a*, 40*b*, 40*c*, and 40*d*.

The image formation unit 40 includes the image bearing member 30, the charger 42, the light exposure section 44, the development section 46, and the transfer section 48. The image formation unit 40 may further include a cleaning section (not illustrated). The cleaning section is for example a cleaning blade. The image bearing member 30 is provided at a central position in the image formation unit 40. The image bearing member 30 is rotatable in an arrow direction (counterclockwise). Around the image bearing member 30, the charger 42, the light exposure section 44, the development section 46, and the transfer section 48 are provided in the stated order from upstream to downstream in a rotation direction of the image bearing member 30. The image formation unit 40 may further include a static eliminating section (not illustrated).

The image formation units 40*a* to 40*d* respectively superimpose toner images of a plurality of colors (for example, black, cyan, magenta, and yellow) in order on the recording medium M on the transfer belt 50. In a situation in which the image forming apparatus 90 is a monochrome image forming apparatus, the image forming apparatus 90 includes the image formation unit 40*a* and omits the image formation units 40*b* to 40*d*.

The charger 42 is a charging roller. The charging roller charges the surface of the image bearing member 30 while in contact with the surface of the image bearing member 30. No particular limitations are placed on the voltage that is applied by the charger 42. The voltage that is applied by the charger 42 is for example a direct current voltage, an alternating current voltage, or a composite voltage (of an alternating current voltage superimposed on a direct current voltage), among which a direct current voltage is preferable. The direct current voltage is advantageous as described below compared to an alternating current voltage and a composite voltage. In a configuration in which the charger 42 only applies a direct current voltage, the value of voltage applied to the image bearing member 30 is constant, and therefore it is easy to uniformly charge the surface of the image bearing member 30 to a specified potential. The amount of abrasion of the photosensitive layer tends to be smaller in a configuration in which the charger 42 only applies a direct current voltage. As a result, favorable images can be formed.

The light exposure section 44 exposes the charged surface of the image bearing member 30 to light. As a result, an electrostatic latent image is formed on the surface of the image bearing member 30. The electrostatic latent image is formed based on image data input to the image forming apparatus 90.

The development section 46 develops the electrostatic latent image into a toner image. The development section 46 can also clean the surface of the image bearing member 30. That is, the image forming apparatus 90 according to the second embodiment may adopt a process without a blade cleaner. Typically, toner image transferring ability tends to easily decrease and an image defect due to a reduction in toner image transferring ability tends to easily occur in an image forming apparatus adopting the process without a blade cleaner. However, the image forming apparatus 90 according to the second embodiment includes the photosensitive member according to the first embodiment as the image bearing member 30. Therefore, the image forming apparatus 90 according to the second embodiment can inhibit an image defect due to a reduction in toner image transferring ability even if the image forming apparatus 90 adopts the process without a blade cleaner.

In order that the development section 46 efficiently cleans the surface of the image bearing member 30, the following conditions (1) and (2) are preferably satisfied.

Condition (1): A contact development process is adopted, and a rotation speed of the image bearing member 30 and a rotation speed of the development roller are different.

Condition (2): A difference between a surface potential of the image bearing member 30 and a potential of the development bias satisfies relation (2-1) and relation (2-2) shown below.

$$0(V)<\text{Potential}(V)\text{ of development bias}<\text{Surface potential}(V)\text{ of non-exposed region of image bearing member 30} \quad (2\text{-}1)$$

$$\text{Potential}(V)\text{ of development bias}>\text{Surface potential }(V)\text{ of exposed region of image bearing member 30}>0(V) \quad (2\text{-}2)$$

In relation (2-1), the surface potential (V) of a non-exposed region of the image bearing member 30 refers to a surface potential of a region of the image bearing member 30 that has not been exposed to light by the light exposure section 44. In relation (2-2), the surface potential (V) of an exposed region of the image bearing member 30 refers to a surface potential of a region of the image bearing member 30 that has been exposed to light by the light exposure section 44. Note that the surface potential of the non-exposed region of the image bearing member 30 and the surface potential of the exposed region of the image bearing member 30 are measured after toner image transfer from the image bearing member 30 to the recording medium M by the transfer section 48 and before charging of the surface of the image bearing member 30 by the charger 42 for the next rotation.

When the condition (1) is satisfied, that is, in a configuration in which the contact development process is adopted, and the rotation speed of the image bearing member 30 and the rotation speed of the development roller are different, the surface of the image bearing member is in contact with the development roller, and a residual matter on the surface of the image bearing member 30 is removed by rubbing against the development roller. That is, the image forming apparatus 90 according to the second embodiment may adopt the contact development process. In the image forming apparatus 90 adopting the contact development process, the development section 46 develops the electrostatic latent image into a toner image while in contact with the surface of the image bearing member 30.

Preferably, the rotation speed of the image bearing member 30 is at least 120 mm/second and no greater than 350 mm/second. Preferably, the rotation speed of the development roller is at least 133 mm/second and no greater than 700 mm/second. Preferably, a ratio between the rotation speed $V_P$ of the image bearing member 30 and the rotation speed $V_D$ of the development roller satisfies relation (1-1) shown below. The ratio being not equal to 1 means that the rotation speed of the image bearing member 30 and the rotation speed of the development roller are different.

$$0.5\leq V_P/V_D<0.8 \quad (1\text{-}1)$$

The following describes the condition (2) taking, as an example, a configuration in which the toner has a positive charging polarity, and a reversal development process is adopted. When the condition (2) is satisfied, that is, in a configuration in which the potential of the development bias is different from the surface potential of the image bearing member 30, the surface potential (charge potential) of the image bearing member 30 and the potential of the development bias satisfy relation (2-1) with respect to the non-exposed region. Accordingly, an electrostatic repulsion between remaining toner (also referred to below as residual toner) and the non-exposed region of the image bearing member 30 is greater than an electrostatic repulsion between the residual toner and the development roller. As a result, the residual toner moves from the surface of the image bearing member 30 to the development roller to be collected. The toner tends not to adhere to the non-exposed region of the image bearing member 30.

When the condition (2) is satisfied, that is, in a configuration in which the potential of the development bias is different from the surface potential of the image bearing member 30, the surface potential (post-irradiation potential) of the image bearing member 30 and the potential of the development bias satisfy relation (2-2) with respect to the exposed region. Accordingly, an electrostatic repulsion between the residual toner and the exposed region of the image bearing member 30 is smaller than an electrostatic repulsion between the residual toner and the development roller. As a result, the residual toner on the surface of the image bearing member 30 is maintained on the surface of the image bearing member 30. The toner adheres to the exposed region of the image bearing member 30.

The potential of the development bias is for example at least +250 V and no greater than +400 V. The charge potential of the image bearing member 30 is for example at least +450 V and no greater than +900 V. The post-irradiation potential of the image bearing member 30 is for example at least +50 V and no greater than +200 V. The difference between the potential of the development bias and the charge potential of the image bearing member 30 is for example at least +100 V and no greater than +700 V. The difference between the potential of the development bias and the post-irradiation potential is for example at least +150 V and no greater than +300 V. A potential difference herein refers to an absolute value of the difference. Such a potential difference can for example be established under conditions of "a potential of the development bias of +330 V", "a charge potential of the image bearing member 30 of +600 V", and "a post-irradiation potential of the image bearing member 30 of +100 V".

The transfer section 48 transfers the toner image obtained through development by the development section 46 from the surface of the image bearing member 30 to the recording medium M. The image bearing member 30 is in contact with the recording medium M when the toner image is transferred from the image bearing member 30 to the recording medium M. The transfer section 48 is for example a transfer roller.

The transfer belt 50 conveys the recording medium M to a location between the image bearing member 30 and the transfer section 48. The transfer belt 50 is an endless belt. The transfer belt 50 is rotatable in an arrow direction (clockwise).

After an unfixed toner image is transferred onto the recording medium M by the transfer section 48, the fixing section 52 applies either or both of heat and pressure to the unfixed toner image. The fixing section 52 is for example either or both of a heating roller and a pressure roller. The toner image is fixed to the recording medium M through application of either or both of heat and pressure thereto. As a result, an image is formed on the recording medium M.

Third Embodiment: Process Cartridge

The third embodiment relates to a process cartridge. The process cartridge according to the third embodiment includes the photosensitive member according to the first embodiment. The following describes the process cartridge according to the third embodiment with reference to FIG. 2.

The process cartridge includes a unitized configuration including the image bearing member 30. The process cartridge adopts a unitized configuration including, in addition to the image bearing member 30, at least one selected from the group consisting of the charger 42, the light exposure section 44, the development section 46, and the transfer section 48. The process cartridge is for example equivalent to any one of the image formation units 40*a* to 40*d*. The process cartridge may further include a cleaning section or a static eliminator (not illustrated). The process cartridge may be designed to be freely attachable to and detachable from the image forming apparatus 90. Accordingly, the process cartridge is easy to handle and can be easily and quickly replaced, together with the image bearing member 30, when properties such as sensitivity of the image bearing member 30 deteriorate.

EXAMPLES

The following provides more specific description of the present disclosure through use of Examples. However, the present disclosure is not in any way limited by the scope of the Examples.

[Photosensitive Member Materials]

A charge generating material, a hole transport material, an electron transport material, and a binder resin described below were prepared as materials for formation of photosensitive layers of photosensitive members.

A compound (CGM-1X) was prepared as the charge generating material. The compound (CGM-1X) was a metal-free phthalocyanine pigment represented by chemical formula (CGM-1) described in association with the first embodiment. The compound (CGM-1X) had an X-form crystal structure.

The hole transport material (HTM-1) and the electron transport material (ETM-1) described in association with the first embodiment were prepared.

Additives (ADD-B1) to (ADD-B8) and the carboxylic acid anhydrides (ADD-1) to (ADD-28) described in association with the first embodiment were prepared. The additives (ADD-B1) to (ADD-B8) are respectively represented by chemical formulae (ADD-B1) to (ADD-B8).

(ADD-B1)

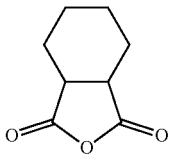

-continued (ADD-B2)

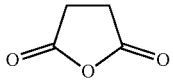

(ADD-B3)

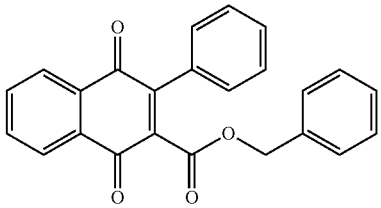

(ADD-B4)

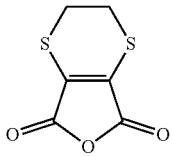

(ADD-B5)

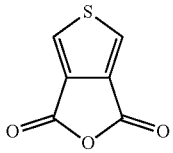

(ADD-B6)

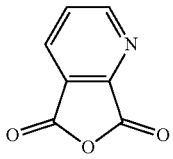

(ADD-B7)

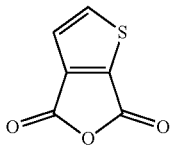

(ADD-B8)

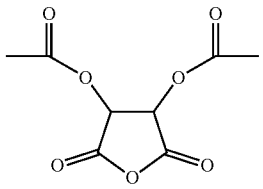

A polycarbonate resin (Za) was prepared as the binder resin. The polycarbonate resin (Za) was the polycarbonate resin represented by chemical formula (Z) described in association with the first embodiment.

[Photosensitive Member Production]

The materials prepared for formation of photosensitive layers of photosensitive members were used to produce photosensitive members (A-1) to (A-32) and photosensitive members (B-1) to (B-11).

(Production of Photosensitive Member (A-1))

First, a conductive substrate was prepared. The conductive substrate was an aluminum conductive substrate having a diameter of 160 mm, a length of 365 mm, and a thickness of 2 mm.

An application liquid was prepared. Into a vessel, 2 parts by mass of the compound (CGM-1X) as the charge generating material, 60 parts by mass of the hole transport material (HTM-1), 35 parts by mass of the electron transport material (ETM-1), 100 parts by mass of the polycarbonate resin (Za) as the binder resin, 0.02 parts by mass of the carboxylic acid anhydride (ADD-1) as the additive, and 800 parts by mass of tetrahydrofuran as a solvent were added. The vessel contents were mixed for dispersion using a ball mill for 50 hours to yield the application liquid.

Next, the application liquid was applied onto the conductive substrate by dip coating to form a film on the conductive substrate. More specifically, the conductive substrate was immersed in the application liquid. Next, the immersed conductive substrate was drawn out of the application liquid. Through the above, the application liquid was applied onto the surface of the conductive substrate.

Next, the conductive substrate having a film of the application liquid was dried by hot air at 100° C. for 40 minutes. Through the above, the solvent (tetrahydrofuran) was removed from the film. As a result, the photosensitive layer was formed on the conductive substrate. The above process yielded the photosensitive member (A-1).

(Production of Photosensitive Members (A-2) to (A-32) and Photosensitive Members (B-1) to (B-11))

The photosensitive members (A-2) to (A-32) and (B-1) to (B-11) were produced according to the same method as the production of the photosensitive member (A-1) in all aspects other than the changes described below.

The carboxylic acid anhydride (ADD-1) used as the additive for preparation of the application liquid in the production of the photosensitive member (A-1) was changed to different additives as shown in Tables 1 and 2. The amount of the additive contained relative to 100 parts by mass of the binder resin was changed from 0.02 parts by mass to different amounts as shown in Tables 1 and 2.

[Measurement Methods]

(Measurement of Additive Reduction Potential)

The reduction potential of each additive was measured by cyclic voltammetry under the following conditions.

Working electrode: glassy carbon

Counter electrode: platinum

Reference electrode: silver/silver nitrate (0.1 mol/L, a solution of $AgNO_3$ in acetonitrile)

Sample solution electrolyte: tetra-n-butylammonium perchlorate (0.1 mol)

Measurement target: carboxylic acid anhydrides (ADD-1) to (ADD-28) and additives (ADD-B1) to (ADD-B8) (0.001 mol)

Solvent: dichloromethane (1 L)

(Measurement of Photosensitive Member Surface Potential)

An electrometer ("MODEL 244", product of Monroe Electronics, Inc.) was used. With respect to each of the photosensitive members, an electrometer probe ("MODEL 1017AS", product of Monroe Electronics, Inc.) was placed in a position where image transfer was performed, and the surface potential of an exposed region of the photosensitive member after the image transfer was measured under conditions of a temperature of 23° C., a relative humidity of 50%, a drum linear velocity of 165 mm/second, a grid voltage of 600 V, and an inflow current of 300 μA. The columns titled "Post-transfer potential (V)" in Tables 1 and 2 show the measurement results.

[Evaluation Methods]

(Evaluation of Photosensitive Member Sensitivity)

An electrometer ("MODEL 244", product of Monroe Electronics, Inc.) was used. With respect to each of the photosensitive members, an electrometer probe ("MODEL 1017AE", product of Monroe Electronics, Inc.) was placed in a position of the development section, and the post-irradiation potential of the photosensitive member was measured under conditions of a temperature of 23° C., a relative humidity of 50%, a charge potential of +600 V, a light exposure wavelength of 780 nm, and a light exposure amount of 1.2 $\mu J/cm^2$. The columns titled "Sensitivity" in Tables 1 and 2 show the evaluation results.

(Evaluation of Toner Image Transferring Ability of Photosensitive Member)

With respect to each of the photosensitive members, the photosensitive member was loaded in an evaluation apparatus. A printer (dry-type electrophotographic printer including a semiconductor laser, "FS-1300D", product of KYOCERA Document Solutions Inc.) was used as the evaluation apparatus. The evaluation apparatus included a charging roller as a charger. A direct current voltage was applied to the charging roller. The evaluation apparatus included a transfer section (transfer roller) adopting a direct transfer process. The evaluation apparatus included a development section adopting a contact development process. The evaluation apparatus had no cleaning blade. The development section of the evaluation apparatus was capable of cleaning the surface of the image bearing member. "KYOCERA Document Solutions-brand paper VM-A4 (A4 size)" sold by KYOCERA Document Solutions Inc. was used as paper for the transferring ability evaluation. "TK-131" produced by KYOCERA Document Solutions Inc. was used as a toner for the transferring ability evaluation. The measurement in the transferring ability evaluation was performed in a high temperature and humidity (temperature: 32.5° C., relative humidity: 80%) environment.

The evaluation apparatus including the photosensitive member and the toner were used to form an evaluation image on the paper. The evaluation image is described below in detail with reference to FIG. 4. The image formation was performed under a condition of a linear velocity of 165 mm/second. The transfer roller applied a current of −25 μA to the photosensitive member.

Next, the resultant image was visually observed to determine presence or absence of an image corresponding to an image 208 in areas 210 and 212. Based on the visual observation result, the toner image transferring ability of the photosensitive member was evaluated in accordance with the following evaluation standard. Evaluation A (particularly good) and evaluation B (good) were determined to pass the evaluation. The columns titled "Transferring ability" in Tables 1 and 2 show the evaluation results.

Figure 4:
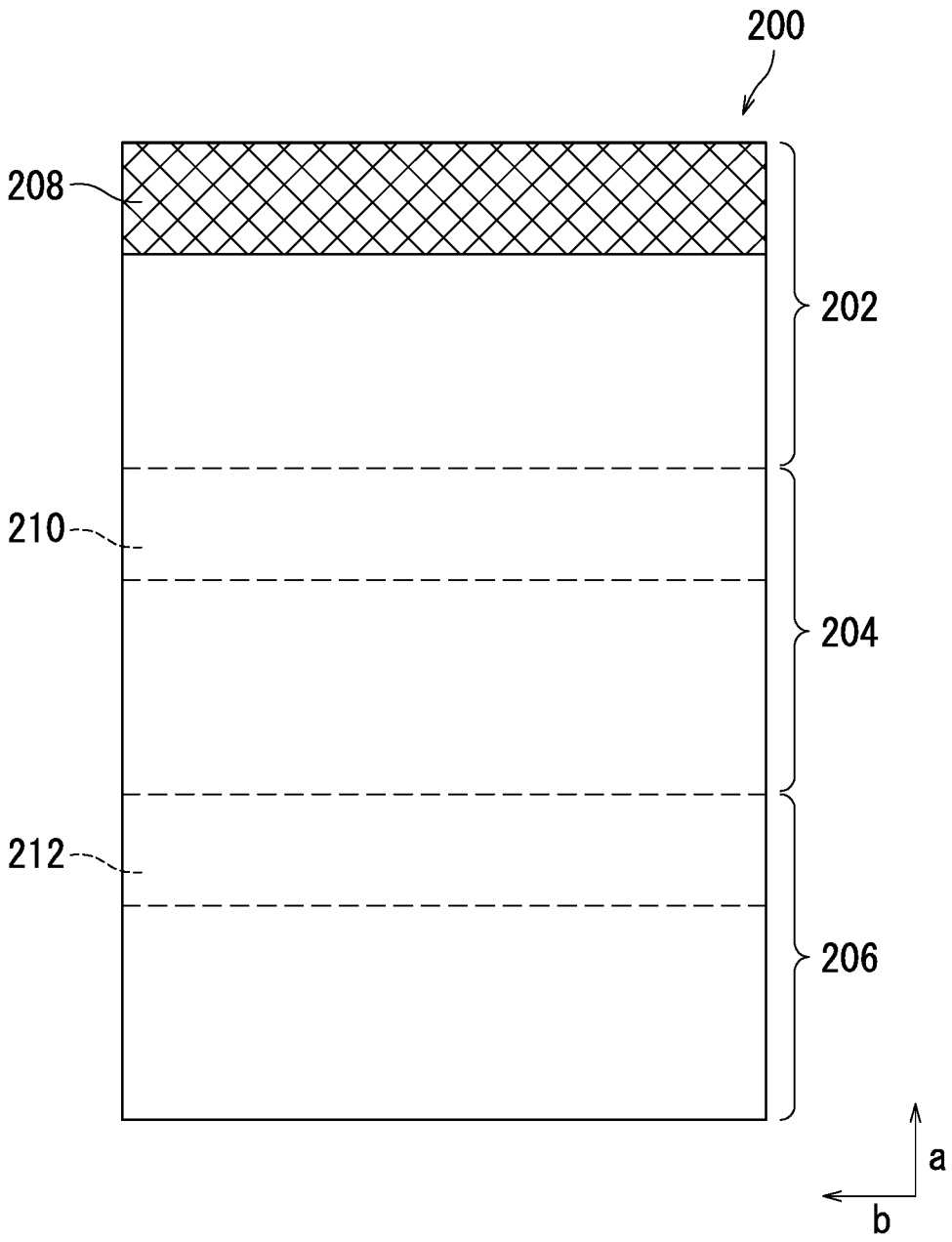
FIG. 4 is a schematic illustration of an evaluation image.

The following describes the evaluation image with reference to FIG. 4. FIG. 4 is a schematic illustration of the evaluation image. An evaluation image 200 had areas 202, 204, and 206. The area 202 was an area corresponding to one rotation of the image bearing member. An image 208 in the area 202 included a solid image (image density 100%). This solid image was rectangular. The areas 204 and 206 were each an area corresponding to one rotation of the image bearing member and each included a white image (image density 0%). In the conveyance direction a, the image 208 in the area 202 was first formed, the white image in the area 204 was subsequently formed, and lastly the white image in the area 206 was formed. The white image in the area 204 was formed through the second rotation of the image bearing member from the rotation (reference rotation) for formation of the image 208. The area 210 was an area corresponding to the image 208 in the area 204. The white image in the area 206 was formed through the third rotation from the reference rotation for formation of the image 208. The area 212 was an area corresponding to the image 208 in the area 206.

(Transferring Ability Evaluation Standard)

Evaluation A (particularly good): No image corresponding to the image 208 was observed in the area 210 or 212.

Evaluation B (good): Images corresponding to the image 208 were slightly observed at opposite ends of the area 210 in terms of the perpendicular direction b. No image corresponding to the image 208 was observed in the area 212.

Evaluation C (poor): Images corresponding to the image 208 were clearly observed at the opposite ends of the area 210 in terms of the perpendicular direction b. No image corresponding to the image 208 was observed in the area 212.

Evaluation D (particularly poor): Images corresponding to the image 208 were clearly observed at opposite ends of the areas 210 and 212 in terms of the perpendicular direction b.

TABLE 1

| | | Additive | | | | Sensitivity | Transferring |
|---|---|---|---|---|---|---|---|
| | Photosensitive No. | Type | Reduction potential (V) | Amount (parts) | Post-transfer potential (V) | Post-irradiation potential (V) | ability Image evaluation |
| Example 1 | A-1 | ADD-1 | −0.78 | 0.02 | 0 | +122 | A |
| Example 2 | A-2 | ADD-1 | −0.78 | 0.30 | +5 | +120 | A |
| Example 3 | A-3 | ADD-1 | −0.78 | 3.00 | +4 | +119 | A |
| Example 4 | A-4 | ADD-1 | −0.78 | 6.00 | +6 | +123 | A |
| Example 5 | A-5 | ADD-1 | −0.78 | 10.00 | +8 | +124 | A |
| Example 6 | A-6 | ADD-2 | −0.74 | 3.00 | −11 | +120 | A |
| Example 7 | A-7 | ADD-3 | −0.78 | 3.00 | −15 | +122 | A |
| Example 8 | A-8 | ADD-4 | −0.97 | 3.00 | +5 | +119 | A |
| Example 9 | A-9 | ADD-5 | −0.80 | 3.00 | −2 | +120 | A |
| Example 10 | A-10 | ADD-6 | −1.26 | 3.00 | −34 | +120 | B |
| Example 11 | A-11 | ADD-7 | −1.37 | 3.00 | −75 | +123 | B |
| Example 12 | A-12 | ADD-8 | −0.97 | 3.00 | −5 | +120 | A |
| Example 13 | A-13 | ADD-9 | −0.96 | 3.00 | −2 | +120 | A |
| Example 14 | A-14 | ADD-10 | −1.02 | 3.00 | −24 | +120 | A |
| Example 15 | A-15 | ADD-11 | −1.01 | 3.00 | −21 | +121 | A |
| Example 16 | A-16 | ADD-12 | −0.77 | 3.00 | +3 | +121 | A |
| Example 17 | A-17 | ADD-13 | −0.75 | 3.00 | +8 | +120 | A |
| Example 18 | A-18 | ADD-14 | −1.01 | 3.00 | −20 | +122 | A |
| Example 19 | A-19 | ADD-15 | −0.75 | 3.00 | +8 | +121 | A |
| Example 20 | A-20 | ADD-16 | −0.77 | 3.00 | +6 | +122 | A |
| Example 21 | A-21 | ADD-17 | −0.99 | 3.00 | −2 | +121 | A |
| Example 22 | A-22 | ADD-18 | −1.04 | 3.00 | −26 | +120 | A |
| Example 23 | A-23 | ADD-19 | −1.03 | 3.00 | −24 | +121 | A |
| Example 24 | A-24 | ADD-20 | −1.22 | 3.00 | −45 | +120 | B |
| Example 25 | A-25 | ADD-21 | −1.23 | 3.00 | −42 | +122 | B |
| Example 26 | A-26 | ADD-22 | −1.24 | 3.00 | −46 | +123 | B |
| Example 27 | A-27 | ADD-23 | −1.32 | 3.00 | −60 | +122 | B |
| Example 28 | A-28 | ADD-24 | −1.28 | 3.00 | −45 | +123 | B |
| Example 29 | A-29 | ADD-25 | −1.27 | 3.00 | −44 | +121 | B |
| Example 30 | A-30 | ADD-26 | −1.30 | 3.00 | −51 | +120 | B |
| Example 31 | A-31 | ADD-27 | −1.34 | 3.00 | −64 | +120 | B |
| Example 32 | A-32 | ADD-28 | −1.22 | 3.00 | −44 | +120 | B |

TABLE 2

| | | Additive | | | | Sensitivity | Transferring |
|---|---|---|---|---|---|---|---|
| | Photosensitive No. | Type | Reduction potential (V) | Amount (parts) | Post-transfer potential (V) | Post-irradiation potential (V) | ability Image evaluation |
| Comparative Example 1 | B-1 | — | — | 0.00 | −183 | +121 | D |
| Comparative Example 2 | B-2 | ADD-1 | −0.78 | 0.01 | −156 | +120 | D |

TABLE 2-continued

| | Photosensitive No. | Additive Type | Additive Reduction potential (V) | Additive Amount (parts) | Post-transfer potential (V) | Sensitivity Post-irradiation potential (V) | Transferring ability Image evaluation |
|---|---|---|---|---|---|---|---|
| Comparative Example 3 | B-3 | ADD-1 | −0.78 | 15.00 | +7 | +181 | A |
| Comparative Example 4 | B-4 | ADD-B1 | −1.45 | 3.00 | −171 | +122 | D |
| Comparative Example 5 | B-5 | ADD-B2 | −1.46 | 3.00 | −182 | +120 | D |
| Comparative Example 6 | B-6 | ADD-B3 | −0.90 | 3.00 | −192 | +122 | D |
| Comparative Example 7 | B-7 | ADD-B4 | −1.50 | 3.00 | −202 | +120 | D |
| Comparative Example 8 | B-8 | ADD-B5 | −1.45 | 3.00 | −181 | +123 | D |
| Comparative Example 9 | B-9 | ADD-B6 | −1.44 | 3.00 | −192 | +121 | D |
| Comparative Example 10 | B-10 | ADD-B7 | −1.45 | 3.00 | −194 | +124 | D |
| Comparative Example 11 | B-11 | ADD-B8 | −1.46 | 3.00 | −194 | +122 | D |

As shown in Table 1, the photosensitive members (A-1) to (A-32) each had a single-layer photosensitive layer that contained a charge generating material, a hole transport material, an electron transport material, and an additive. The additive was a carboxylic acid anhydride, and the reduction potential of the carboxylic acid anhydride was from −1.37 V to −0.74 V versus the reference electrode ($Ag/Ag^+$). The carboxylic acid anhydride was contained in the photosensitive layer in an amount of from 0.02 parts by mass to 10.00 parts by mass relative to 100 parts by mass of the binder resin.

As shown in Table 1, the photosensitive members (A-1) to (A-32) each resulted in a post-irradiation potential of from +119 V to +124 V and each resulted in evaluation A (particularly good) or evaluation B (good) in the toner image transferring ability evaluation.

As shown in Table 2, the photosensitive member (B-1) had a photosensitive layer that did not contain a carboxylic acid anhydride as an additive. The photosensitive members (B-2) and (B-3) contained a carboxylic acid anhydride in an amount of 0.01 parts by mass and 15.00 parts by mass, respectively, relative to 100 parts by mass of the binder resin. The reduction potential of the additive in each of the photosensitive members (B-4), (B-5), and (B-7) to (B-11) was from −1.50 V to −1.44 V. The reduction potential of the additive (ADD-B3) in the photosensitive member (B-6) was −0.90 V, but the additive was not a carboxylic acid anhydride.

As shown in Table 2, the photosensitive members (B-1), (B-2), and (B-4) to (B-11) each resulted in evaluation D (particularly poor) in the toner image transferring ability evaluation. The photosensitive member (B-3) resulted in evaluation A in the toner image transferring ability evaluation, but resulted in a post-irradiation potential of +181 V.

The results indicate that the photosensitive members (A-1) to (A-32) can achieve both excellent sensitivity characteristics and excellent toner image transferring ability compared to the photosensitive members (B-1) to (B-11).

What is claimed is:

1. An electrophotographic photosensitive member comprising a conductive substrate and a photosensitive layer, wherein:

the photosensitive layer is a single-layer photosensitive layer, the photosensitive layer contains a charge generating material, a hole transport material, an electron transport material, a binder resin, and an additive, the additive contains a carboxylic acid anhydride, a reduction potential of the carboxylic acid anhydride is at least 1.40 V versus a reference electrode ($Ag/Ag^+$), the carboxylic acid anhydride is contained in an amount of at least 0.02 parts by mass and no greater than 10.00 parts by mass relative to 100 parts by mass of the binder resin, and the carboxylic acid anhydride is represented by at least one of chemical formulae (ADD-29) to (ADD-31) shown below (ADD-29)

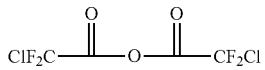

(ADD-30)

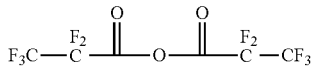

(ADD-31)

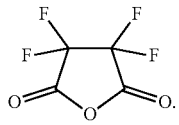

2. A process cartridge comprising the electrophotographic photosensitive member according to claim 1.

3. An image forming apparatus comprising:

an image bearing member;

a charger configured to charge a surface of the image bearing member;

a light exposure section configured to expose the charged surface of the image bearing member to light to form an electrostatic latent image;

a development section configured to develop the electrostatic latent image into a toner image; and a transfer section configured to transfer the toner image from the surface of the image bearing member to a recording medium, wherein the image bearing member is the electrophotographic photosensitive member according to claim 1, and the charger has a positive charging polarity.

4. The image forming apparatus according to claim 3, wherein the charger is a charging roller.

5. The image forming apparatus according to claim 3, wherein the development section develops the electrostatic latent image into the toner image while in contact with the surface of the image bearing member.

6. The image forming apparatus according to claim 3, wherein the development section cleans the surface of the image bearing member.

* * * * *